United States Patent [19]

Nagahiro et al.

[11] Patent Number: 4,727,831

[45] Date of Patent: Mar. 1, 1988

[54] VALVE OPERATING MECHANISM FOR INTERNAL COMBUSTION ENGINE

[75] Inventors: Kenichi Nagahiro; Yoshio Ajiki; Masaaki Katoh, all of Saitama; Kazuo Inoue, Tokyo, all of Japan

[73] Assignee: Honda Giken Kogyo Kabushiki Kaisha, Tokyo, Japan

[21] Appl. No.: 891,754

[22] Filed: Jul. 31, 1986

[30] Foreign Application Priority Data

Jul. 31, 1985 [JP] Japan ..... 60-168717

[51] Int. Cl.[4] ..... F01L 1/26

[52] U.S. Cl. ..... 123/90.16; 123/90.44

[58] Field of Search ..... 123/90.16, 90.39, 90.4, 123/90.41, 90.44, 198 F

[56] References Cited

U.S. PATENT DOCUMENTS

| | | | |
|---|---|---|---|
| 4,523,550 | 6/1985 | Matsuura | 123/90.17 X |
| 4,612,884 | 9/1986 | Ajiki et al. | 123/90.16 |
| 4,656,977 | 4/1987 | Nagahiro et al. | 123/90.16 |

*Primary Examiner*—Tony M. Argenbright
*Attorney, Agent, or Firm*—Lyon & Lyon

[57] ABSTRACT

A valve operating mechanism for operating a pair of valves of an internal combustion engine, includes a camshaft rotatable in synchronism with rotation of the internal combustion engine and having a first low-speed cam, a second low-speed cam, and a high-speed cam which have different cam profiles, respectively, the first and second low-speed cams being disposed one on each side of the high-speed cam, a rocker shaft, and first, second, and third rocker arms rotatably mounted on the rocker shaft and held in sliding contact with the first low-speed cam, the second low-speed cam, and the high-speed cam, respectively, for operating the valves according to the cam profiles of the cams. A selective coupling is operatively disposed in and between the first, second, and third rocker arms for selectively interconnecting the first, second, and third rocker arms to allow angular movement thereof in unison and disconnecting the first, second, and third rocker arms to allow separate angular movement thereof.

14 Claims, 7 Drawing Figures

VALVE OPERATING MECHANISM FOR INTERNAL COMBUSTION ENGINE

The present invention relates to a valve operating mechanism for an internal combustion engine, including a camshaft rotatable in synchronism with the rotation of the internal combustion engine and having integral cams for operating a pair of intake or exhaust valves, and rocker arms angularly removably supported on a rocker shaft for opening and closing the intake or exhaust valves in response to rotation of the cams.

Valve operating mechanisms used in internal combustion engines are generally designed to meet requirements for high-speed operation of the engines. More specifically, the valve diameter and valve lift are selected not to exert substantial resistance to the flow of an air-fuel mixture which is introduced through a valve into a combustion chamber at a rate for maximum engine power.

If an intake valve is actuated at constant valve timing and valve lift throughout a full engine speed range from low to high speeds, then the speed of flow of an air-fuel mixture into the combustion chamber varies from engine speed to engine speed since the amount of air-fuel mixture varies from engine speed to engine speed. At low engine speeds, the speed of flow of the air-fuel mixture is lowered and the air-fuel mixture is subject to less turbulence in the combustion chamber, resulting in slow combustion therein. Therefore, the combustion efficiency is reduced and so is the fuel economy, and the knocking margin is lowered due to the slow combustion.

One solution to the above problems is disclosed in Japanese Laid-Open Patent Publication No. 59(1984)-226216. According to the disclosed arrangement, some of the intake or exhaust valves remain closed when the engine operates at a low speed, whereas all of the intake or exhaust valves are operated, i.e., alternately opened and closed, during high-speed operation of the engine. Therefore, the valves are controlled differently in low- and high-speed ranges.

In the prior valve operating mechanism described above, those intake valves which are not operated in the low-speed range may remain at rest for a long period of time under a certain operating condition. If an intake valve remains at rest for a long time, carbon produced by fuel combustion tends to be deposited between the intake valve and its valve seat, causing the intake valve to stick to the valve seat. When the engine starts to operate in the high-speed range, the intake valve which has been at rest is forcibly separated from the valve seat. This causes the problem of a reduced sealing capability between the intake valve and the valve seat. Furthermore, fuel tends to be accumulated on the intake valve while it is held at rest, with the result that when the intake valve is opened, the air-fuel mixture introduced thereby is excessively enriched by the accumulated fuel.

SUMMARY OF THE INVENTION

It is an object of the present invention to provide a valve operating mechanism for an internal combustion engine, which operates intake or exhaust valves during low-speed operation of the engine in a manner to solve the aforesaid problems, and is designed to improve fuel economy, prevent knocking, and increase engine output power.

According to the present invention, there is provided a valve operating mechanism for operating a pair of valves of an internal combustion engine, comprising a camshaft rotatable in synchronism with rotation of the internal combustion engine and having a first low-speed cam, a second low-speed cam, and a high-speed cam which have different cam profiles, respectively, the first and second low-speed cams being disposed one on each side of the high-speed cam, a rocker shaft, first, second, and third rocker arms rotatably mounted on the rocker shaft and held in sliding contact with the first low-speed cam, the second low-speed cam, and the high-speed cam, respectively, for operating the valves according to the cam profiles of the cams, and means operatively disposed in and between the first, second, and third rocker arms for selectively interconnecting the first, second, and third rocker arms to allow angular movement thereof in unison and disconnecting the first, second, and third rocker arms to allow separate angular movement thereof.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
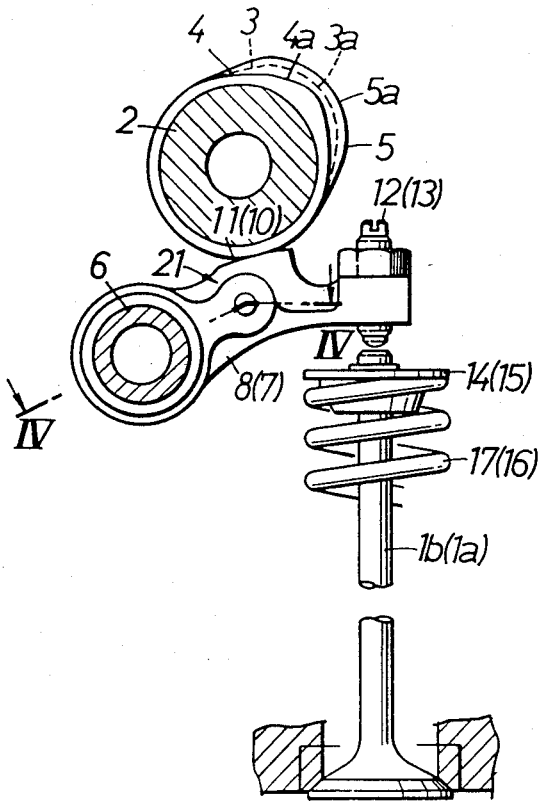
FIG. 1 is a vertical cross-sectional view of a valve operating mechanism according to the present invention, the view being taken along line I—I of FIG. 2.
Figure 2:
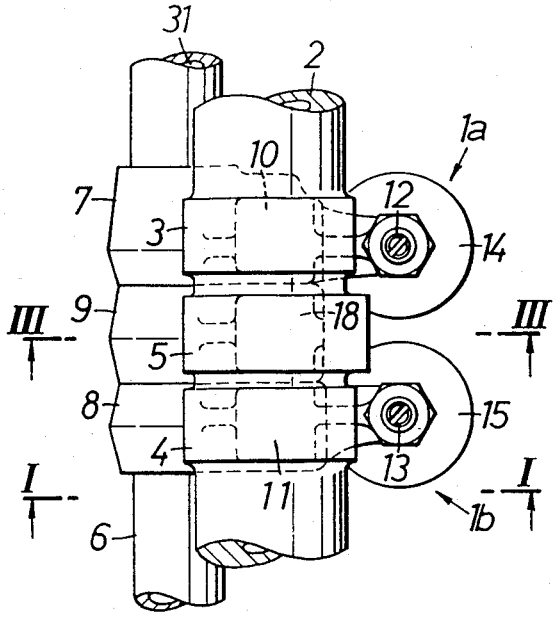
FIG. 2 is a plan view of the valve operating mechanism shown in FIG. 1.

FIGS. 1 and 2 show a valve operating mechanism according to an embodiment of the present invention. The valve operating mechanism is incorporated in an internal combustion engine including a pair of intake valves 1*a*, 1*b* in each engine cylinder for introducing an air-fuel mixture into a combustion chamber defined in an engine body.

The valve operating mechanism comprises a camshaft 2 rotatable in synchronism with rotation of the engine at a speed ratio of ½ with respect to the speed of rotation of the engine crankshaft. The camshaft 2 has a first low-speed cam 3, a second low-speed cam 4, and a high-speed cam 5 which are integral with the camshaft 2. The valve operating mechanism also has a rocker shaft 6 extending parallel to the camshaft 2, and first through third rocker arms 7, 8, 9 angularly movably supported on the rocker shaft 6 and held against the first low-speed cam 3, the second low-speed cam 4, and the high-speed cam 5, respectively, on the camshaft 2. The intake valves 1*a*, 1*b* are selectively operated by the first through third rocker arms 7, 8, 9 actuated by the cams 3, 4, 5.

The camshaft 2 is rotatably disposed above the engine body. The first low-speed cam 3 on the camshaft 2 is positioned in alignment with the intake valve 1*a*, and the second low-speed cam 4 on the camshaft 2 is positioned in alignment with the intake valve 1*b*. The high-speed cam 5 is disposed in a position corresponding to an intermediate position between the intake valves 1*a*, 1*b*, as viewed in FIG. 2. The first low-speed cam 3 has a cam lobe 3*a* projecting radially outwardly to a relatively small extent to meet low-speed operation of the engine, and the high-speed cam 5 has a cam lobe 5*a* projecting radially outwardly a greater extent than the cam lobe 3*a* to meet high-speed operation of the engine with the cam lobe 5*a* also having a larger angular extent than the cam lobe 3*a*. The second low-speed cam 4 has a cam lobe 4*a* projecting radially outwardly to a relatively small extent to meet low-speed operation of the engine, the cam lobe 4*a* being smaller than the cam lobe 3*a*.

The rocker shaft 6 is fixed below the camshaft 2. The first and second rocker arms 7, 8 pivotally mounted on the rocker shaft 6 are identical in configuration to each other. The first and second rocker arms 7, 8 have base portions angularly movably supported on the rocker shaft 6 in substantial alignment with the intake valves 1*a*, 1*b*, as shown in FIG. 2, and have distal ends positioned above the intake valves 1*a*, 1*b*, respectively. The first rocker arm 7 has on its upper surface a cam slipper 10 held in sliding contact with the first low-speed cam 3, and the second rocker arm 8 has on its upper surface a cam slipper 11 held in sliding contact with the second low-speed cam 4. Tappet screws 12, 13 are threaded through the distal ends of the first and second rocker arms 7, 8 and have tips engagable respectively with the upper ends of the valve stems of the intake valves 1*a*, 1*b*.

Flanges 14, 15 are attached to the upper ends of the valve stems of the intake valves 1*a*, 1*b*. The intake valves 1*a*, 1*b* are normally urged to close the intake ports by compression coil springs 16, 17 disposed under compression around the valve stems between the flanges 14, 15 and the engine body.

Figure 3:
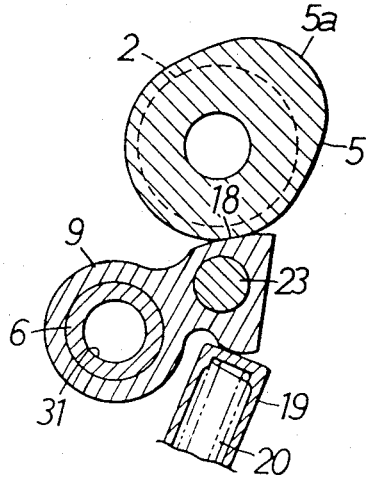
FIG. 3 is a cross-sectional view taken along line III—III of FIG. 1.

As shown in FIG. 3, the third rocker arm 9 is pivotally supported on the rocker shaft 6 between the first and second rocker arms 7, 8. The third rocker arm 9 extends radially from the rocker shaft 6 a short distance toward the side of the intake valves 1*a*, 1*b*. The third rocker arm 9 has on its upper surface a cam slipper 18 held in sliding engagement with the high-speed cam 5. A bottomed cylindrical lifter 19 is disposed in abutment against a lower surface of the third rocker arm 9. The lifter 19 is normally urged upwardly by a compression spring 20 of relatively weak resiliency interposed between the lifter 19 and the engine body for resiliently biasing the cam slipper 18 of the third rocker arm 9 slidably against the high-speed cam 5.

Figure 4:
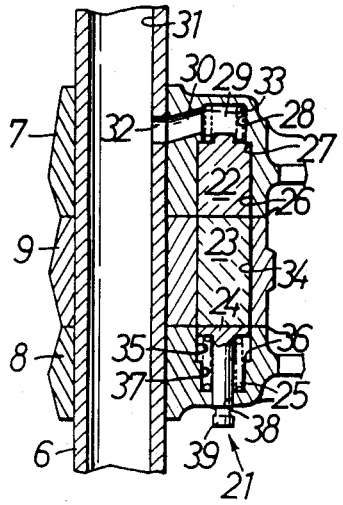
FIG. 4 is a cross-sectional view taken along line IV—IV of FIG. 1, showing the first through third rocker arms interconnected.

As illustrated in FIG. 4, the first, second, and third rocker arms 7, 8, 9 have confronting side walls held in mutual sliding contact. A selective coupling 21 is operatively disposed in and between the first through third rocker arms 7, 8, 9 for selectively disconnecting the rocker arms 7, 8, 9 from each other for relative displacement and also for interconnecting the rocker arms 7, 8, 9 for their angular movement in unison.

The selective coupling 21 comprises a first piston 22 movable between a position in which it interconnects the first and third rocker arms 7, 9 and a position in which it disconnects the first and third rocker arms 7, 9 from each other, a second piston 23 movable between a position in which it interconnects the third and second rocker arms 9, 8 and a position in which it disconnects the third and second rocker arms 9, 8 from each other, a circular stopper 24 for limiting the movement of the first and second pistons 22, 23, and a coil spring 25 for urging the stopper 24 to move the first and second pistons 22, 23 toward their positions to disconnect the first and third rocker arms 7, 9 from each other and the third and second rocker arms 9, 8 from each other.

The first rocker arm 7 has a first guide hole 26 opening toward the third rocker arm 9 and extending parallel to the rocker shaft 6. The first rocker arm 7 also has a smaller-diameter hole 28 near the closed end of the first guide hole 26, with a step or shoulder 27 being defined between the smaller-diameter hole 28 and the first guide hole 26. The first piston 22 is slidably fitted in the first guide hole 26. The first piston 22 and the closed end of the smaller-diameter hole 28 define therebetween a hydraulic pressure chamber 29.

The first rocker arm 7 has a hydraulic passage 30 defined therein in communication with the hydraulic pressure chamber 29. The rocker shaft 6 has a hydraulic passage 31 defined axially therein and coupled to a source (not shown) of hydraulic pressure through a suitable hydraulic pressure control mechanism. The hydraulic passages 30, 31 are held in communication with each other through a hole 32 defined in a side wall of the rocker shaft 6, irrespective of how the first rocker arm 7 is angularly moved about the rocker shaft 6.

The first piston 22 has an axial length selected such that when one end of the first piston 22 abuts against the step 27, the other end thereof is positioned just between and hence lies flush with the sliding side walls of the first and third rocker arms 7, 9 without projecting from the side wall of the first rocker arm 7 toward the third rocker arm 9. The first piston 22 is normally urged toward the third rocker arm 9 under the resiliency of a coil spring 33 disposed in the hydraulic pressure chamber 29 and acting between the first piston 22 and the closed bottom of the smaller-diameter hole 28. The resilient force of the spring 33 set under compression in the hydraulic pressure chamber 29 is selected to be smaller than that of the spring 25 set in place under compression.

The third rocker arm 9 has a guide hole 34 defined thereacross and extending between the opposite sides thereof in registration with the first guide hole 26 in the first rocker arm 7. The second piston 23 is slidably fitted in the guide hole 34, the second piston 23 having a length equal to the full length of the guide hole 34. The second piston 23 has an outside diameter equal to that of the first piston 22.

The second rocker arm 8 has a second guide hole 35 opening toward the third rocker arm 9 in registration with the guide hole 34. The circular stopper 24 is slidably fitted in the second guide hole 35. The second rocker arm 8 also has a smaller-diameter hole 37 near the closed end of the second guide hole 35, with a step or shoulder 36 defined between the second guide hole 35 and the smaller-diameter hole 37 for limiting movement of the circular stopper 24. The second rocker arm 8 also has a smaller-diameter through hole 38 defined coaxially with the smaller-diameter hole 37. A guide rod 39 joined integrally and coaxially to the circular stopper 24 extends through the hole 38. The coil spring 25 is disposed around the guide rod 39 between the stopper 24 and the closed end of the smaller-diameter hole 37.

Figure 5:
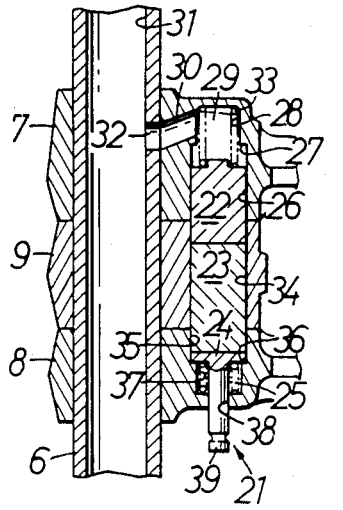
FIG. 5 is a cross-sectional view similar to FIG. 4, showing the first through third rocker arms disconnected from each other.

Operation of the valve operating mechanism will be described with reference to FIGS. 4 and 5. When the engine is to operate in a low-speed range, no hydraulic pressure is supplied to the hydraulic pressure chamber 29, and the stopper 24 is forced by the spring 25 toward the third rocker arm 9 until the first piston 22 is moved by the second piston 23 into abutment against the step 27. At this time, the mutually contacting ends of the first and second pistons 22, 23 lie flush with the confronting sliding side surfaces of the first and third rocker arms 7, 9, and the mutually contacting ends of the second piston 23 and the stopper 24 lie flush with the confronting sliding side surfaces of the third and second rocker arms 9, 8, as shown in FIG. 4. Therefore, the first through third rocker arms 7, 8, 9 are relatively angularly movable while the first and second pistons 22, 23 and the second piston 23 and the stopper 24 are in sliding contact with each other.

When the camshaft 2 is rotated about its own axis with the first through third rocker arms 7, 8, 9 being thus disconnected by the selective coupling 21, the first rocker arm 7 is angularly moved in sliding contact with the first low-speed cam 3, whereas the second rocker arm 8 is angularly moved in sliding contact with the second low-speed cam 4. Therefore, the intake valves 1*a*, 1*b* are caused by the first and second low-speed cams 3, 4 to alternately open and close the respective intake ports. The angular movement of the third rocker arm 9 in sliding contact with the high-speed cam 5 does not affect operation of the intake valves 1*a*, 1*b* in any way.

During low-speed operation of the engine, therefore, the intake valve 1*a* alternately opens and closes the intake port at the valve timing and valve lift according to the profile of the first low-speed cam 3, whereas the intake valve 1*b* alternately opens and closes the intake port at the valve timing and valve lift according to the profile of the second low-speed cam 4. Accordingly, the air-fuel mixture flows into the combustion chamber at a rate suitable for the low-speed operation of the engine, resulting in improved fuel economy and prevention of knocking. Since the cam profiles of the first and second low-speed cams 3, 4 are different from each other, the turbulence of the air-fuel mixture as it is supplied into the combustion chamber is increased for better fuel economy. Furthermore, inasmuch as both of the intake valves 1*a*, 1*b* are operated, no carbon will be deposited between the intake valves 1*a*, 1*b* and their valve seats, and no reduction in the sealing capability between the intake valves 1*a*, 1*b* and their valve seats will be encountered. In addition, no fuel will be accumulated on the intake valves 1*a*, 1*b*.

For high-speed operation of the engine, the hydraulic pressure is supplied to the hydraulic pressure chamber 29 to move the first piston 22 toward the third rocker arm 9 against the resiliency of the spring 25, thereby displacing the second piston 23 toward the second rocker arm 8. As a result, the first and second pistons 22, 23 are moved until the stopper 24 abuts against the step 36, as illustrated in FIG. 5. Consequently, the first and third rocker arms 7, 9 are interconnected by the first piston 22 positioned therebetween, and the third and second rocker arms 9, 8 are interconnected by the second piston 23 positioned therebetween.

The first and second rocker arms 7, 8 are now caused to swing in unison with the third rocker arm 9 since the third rocker arm 9 is angularly moved to the greatest angular extent in sliding contact with the high-speed cam 5. The intake valves 1*a*, 1*b* alternately open and close the respective intake ports at the valve timing and valve lift according to the cam profile of the high-speed cam 5, so that the engine output power can be increased.

Figure 6:
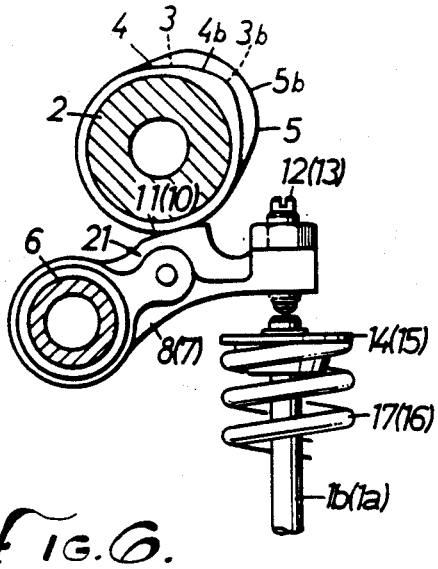
FIG. 6 is a vertical cross-sectional view similar to FIG. 1 showing a second embodiment of the valve operating mechanism of this invention.

Referring now to FIG. 6, a second embodiment is shown wherein the first low-speed cam 3 and the second low-speed cam 4 have the same cam lobe profiles whereby the valves 1*a* and 1*b* are operated in an identical manner during low-speed operation of the engine when the rocker arms are disconnected by the mechanism 21. At high speeds the valves are operated by the high-speed cam 5 in the same manner as the first embodiment.

Figure 7:
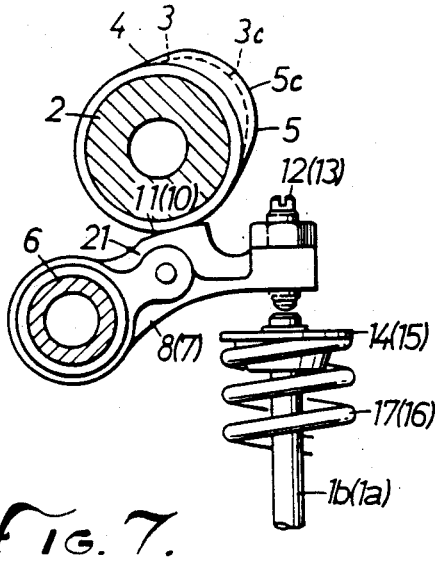
FIG. 7 is a vertical cross-sectional view similar to FIGS. 1 and 6 showing a third embodiment of the valve operating mechanism of this invention.

Referring to FIG. 7, a third embodiment is shown wherein the second low-speed cam 4 is circular and of a diameter of the base circle of the cam 4 while the first low-speed cam is of a desired shape for low-speed operation. During low-speed operation the rocker arms 7, 8 and 9 are disconnected to operate independently, as previously described, and therefore valve 1*b* remains closed, because cam 4 has no cam lobe thereon, while valve 1*a* opens and closes in response to cam lobe 3*a*. Again, as with the embodiments of FIGS. 1 and 6, at high speed the valves are operated by the high-speed cam 5. In all other respects the embodiments of FIGS. 6 and 7 are the same as the embodiment of FIGS. 1–5.

While the intake valves 1*a*, 1*b* are shown as being operated by each of the valve operating mechanism, exhaust valves may also be operated by the valve operating mechanisms according to the present invention. In such a case, unburned components due to exhaust gas turbulence can be reduced in low-speed operation of the engine, whereas high engine output power and torque can be generated by reducing resistance to the flow of an exhaust gas from the combustion chamber in high-speed operation of the engine.

Although a certain preferred embodiment has been shown and described, it should be understood that many changes and modifications may be made therein without departing from the scope of the appended claims.

What is claimed:

1. A valve operating mechanism for operating a pair of valves of an internal combustion engine, comprising:

a camshaft rotatable in synchronism with rotation of the internal combustion engine and having a first low-speed cam, a second low-speed cam, and a high-speed cam which have different cam profiles, respectively, said first and second low-speed cams being disposed one on each side of said high-speed cam;

a rocker shaft;

first, second, and third rocker arms rotatably mounted on said rocker shaft and held in sliding contact with said first low-speed cam, said second low-speed cam, and said high-speed cam, respectively, for operating the valves according to the cam profiles of said cams; and means operatively disposed in and between said first, second, and third rocker arms for selectively interconnecting the first, second, and third rocker arms to allow angular movement thereof in unison and disconnecting said first, second, and third rocker arms to allow separate angular movement thereof.

2. A valve operating mechanism according to claim 1, including lifter means for normally urging said third rocker arm resiliently into sliding contact with said high-speed cam.

3. A valve operating mechanism according to claim 1, wherein said first and second rocker arms have ends for operating said valves, respectively.

4. A valve operating mechanism according to claim 1, wherein said means comprises a selective coupling composed of a first guide hole defined in said first rocker arm, a second guide hole defined in said second rocker arm in registration with said first guide hole, a third guide hole defined in said third rocker arm, a first piston slidably fitted in said first guide hole, a second piston slidably fitted in said third guide hole, a spring disposed in said second guide hole for normally urging said first and second pistons into said first and third guide holes, respectively, and means for applying hydraulic pressure to said first piston to move the first and second pistons to respective positions between said first and third guide and said third and second guide holes, respectively, against the resiliency of said spring.

5. A valve operating mechanism for operating a pair of valves of an internal combustion engine, comprising:

a camshaft rotatable in synchronism with rotation of the internal combustion engine and having a first valve cam, a second valve cam, and a high-speed cam, said high-speed cam having a different cam profile than said valve cams, said first and second valve cams being disposed one on each side of said high-speed cam;

a rocker shaft;

first, second, and third rocker arms rotatably mounted on said rocker shaft and held in sliding contact with said first valve cam, said second valve cam, and said high-speed cam respectively, for operating the valves according to the cam profiles of said cams;

said first rocker arm engaging one of the valves of the pair of valves and the second rocker arm engaging the other of the valves of the pair of valves for said first and second rocker arms to separately operate each of the valves of the pair of valves; and means operatively disposed in and between said first, second, and third rocker arms for selectively interconnecting the first, second, and third rocker arms to allow angular movement thereof in unison and disconnecting said first, second, and third rocker arms to allow separate angular movement thereof.

6. A valve operating mechanism according to claim 5, including lifter means for normally urging said third rocker arm resiliently into sliding contact with said high-speed cam.

7. A valve operating mechanism according to claim 5, wherein said first and second valve cams have cam lobes of a different shape for operating each of the valves of the pair of valves in a different opening and closing manner.

8. A valve operating mechanism according to claim 5 wherein said first and second valve cams have cam lobes of substantially identical shape for operating the pair of valves in a substantially identical manner.

9. A valve operating mechanism according to claim 5 wherein said first valve cam has a cam lobe of a profile for operating the valve engaged by the first rocker arm in a manner for low speed engine operation and said second valve cam has a profile of a base circle for leaving closed the valve engaged by the second rocker arm when the rocker arms are disconnected by said means.

10. A valve operating mechanism for operating valve means of an internal combustion engine, comprising:

a camshaft rotatable in synchronism with rotation of said engine;

a plurality of driver rocker arms connecting said valve means to open and close said valve means accordance with a desired mode of operation, and a free rocker arm interposed between said driver rocker arms in side-by-side relation thereto;

a plurality of cams on said camshaft, each engaging one of said rocker arms and each having a cam profile effective to impart a desired mode of operation to said valve means;

coupling means for selectively interconnecting and disconnecting said rocker arms including couplings operative between adjacent rocker arms; and means for selectively actuating said couplings.

11. A valve operating mechanism according to claim 10 in which said coupling means comprises guide holes adapted for mutual registration in each of said rocker arms; a movable piston in each of said guide holes, said pistons having end surfaces normally aligned with the sides of said rocker arms for relative pivotal movement therebetween; said actuating means being operative to move said pistons for interconnecting said driver and free rocker arms.

12. A valve operating mechanism according to claim 11 including means for supplying hydraulic pressure to one of said pistons for actuating said coupling means.

13. A valve operating mechanism according to claim 12 including a rocker shaft mounting said rocker arms for pivotal movement; a hydraulic supply passage in said rocker arm; and means connecting said hydraulic supply passage to said one piston.

14. A valve operating mechanism according to claim 13 in which said free rocker arm contains a piston having one axial length coextensive with the length of the guide hole therein; and spring means for normally biasing said pistons in said driver rocker arms into end-to-end engagement with said free rocker arm piston.

* * * * *